US008247157B2

(12) United States Patent
Nosella et al.

(10) Patent No.: US 8,247,157 B2
(45) Date of Patent: Aug. 21, 2012

(54) TONER PROCESS

(75) Inventors: Kimberly D. Nosella, Mississauga (CA); Enno E. Agur, Toronto (CA); Shigang Qiu, Toronto (CA); Ke Zhou, Oakville (CA)

(73) Assignee: Xerox Corporation, Norwalk, CT (US)

( * ) Notice: Subject to any disclaimer, the term of this patent is extended or adjusted under 35 U.S.C. 154(b) by 50 days.

(21) Appl. No.: 12/330,863

(22) Filed: Dec. 9, 2008

(65) Prior Publication Data

US 2010/0143839 A1 Jun. 10, 2010

(51) Int. Cl.
*G03G 9/08* (2006.01)
*G03G 9/00* (2006.01)

(52) U.S. Cl. ..... 430/137.14; 430/137.1; 525/369; 524/284

(58) Field of Classification Search ..... 430/137.14; 525/369; 524/284
See application file for complete search history.

(56) References Cited

U.S. PATENT DOCUMENTS

| | | | |
|---|---|---|---|
| 3,590,000 | A | 6/1971 | Palermiti et al. |
| 3,847,604 | A | 11/1974 | Hagenbach et al. |
| 4,295,990 | A | 10/1981 | Verbeek et al. |
| 4,298,672 | A | 11/1981 | Lu |
| 4,338,390 | A | 7/1982 | Lu |
| 4,935,326 | A | 6/1990 | Creatura et al. |
| 4,937,166 | A | 6/1990 | Creatura et al. |
| 5,236,629 | A | 8/1993 | Mahabadi et al. |
| 5,290,654 | A | 3/1994 | Sacripante et al. |
| 5,302,486 | A | 4/1994 | Patel et al. |
| 5,330,874 | A | 7/1994 | Mahabadi et al. |
| 5,843,614 | A | 12/1998 | Shinzo et al. |
| 6,063,827 | A | 5/2000 | Sacripante et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,425,398 | B2 | 9/2008 | Nosella et al. |
| 2006/0222991 | A1 | 10/2006 | Sacripante et al. |
| 2008/0107989 | A1 | 5/2008 | Sacripante et al. |
| 2008/0182193 | A1 | 7/2008 | Agur et al. |
| 2008/0197283 | A1 | 8/2008 | Veregin et al. |

FOREIGN PATENT DOCUMENTS

| | | | |
|---|---|---|---|
| EP | 1921508 | * | 5/2008 |
| JP | 2002-256077 | | 11/2002 |

* cited by examiner

*Primary Examiner* — Duc Truong
(74) *Attorney, Agent, or Firm* — MDIP LLC

(57) ABSTRACT

The present disclosure provides processes for increasing the shelf life and stability of resin emulsions suitable for use in forming toner particles. In embodiments, the pH of the resin emulsion is monitored, and a base is added as needed to maintain the pH of the emulsion at from about 6.5 to about 8. Maintaining the pH at from about 6.5 to about 8 prevents the degradation of the resin in the emulsion, including its molecular weight.

20 Claims, 4 Drawing Sheets

TONER PROCESS

BACKGROUND

The present disclosure relates to toners suitable for electrostatographic apparatuses and processes for making such toners.

Toner blends containing crystalline or semi-crystalline polyester resins with an amorphous resin have been recently shown to provide very desirable ultra low melt fusing, which is important for both high-speed printing and lower fuser power consumption. These types of toners containing crystalline polyester have been demonstrated for both emulsion aggregation (EA) toners, and in conventional jetted toners. One issue with the resin emulsions utilized to prepare polyester EA ultra low melt (ULM) toners, prior to preparation of toners therefrom, is the possibility that they may degrade with time. Methods which avoid this degradation remain desirable.

SUMMARY

The present disclosure provides processes for producing resin emulsions. The resin emulsions may then be utilized to form toner particles. In embodiments, the pH of the resin emulsion is monitored and adjusted to maintain the pH at a desired level, which may increase the shelf life and stability of the resin emulsion. In embodiments, a process of the present disclosure may include forming a polyester resin emulsion, monitoring the pH of the emulsion, and adding a base to the emulsion to maintain the emulsion at a pH of from about 6.5 to about 8.

In other embodiments, a process of the present disclosure may include forming a polyester resin emulsion, monitoring the pH of the emulsion, and adding to the emulsion a base such as sodium hydroxide, ammonium hydroxide, potassium hydroxide, lithium hydroxide, beryllium hydroxide, magnesium hydroxide, calcium hydroxide, barium hydroxide, ammonium hydroxide, sodium bicarbonate, lithium bicarbonate, potassium bicarbonate, lithium carbonate, potassium carbonate, sodium carbonate, beryllium carbonate, magnesium carbonate, calcium carbonate, barium carbonate, and combinations thereof, to maintain the emulsion at a pH of from about 6.5 to about 8, wherein adding the base to the emulsion prevents a decrease in the molecular weight of the resin in the emulsion.

In yet other embodiments, a process of the present disclosure may include forming a polyester resin emulsion, monitoring the pH of the emulsion, adding to the emulsion a base such as sodium hydroxide, ammonium hydroxide, potassium hydroxide, lithium hydroxide, beryllium hydroxide, magnesium hydroxide, calcium hydroxide, barium hydroxide, ammonium hydroxide, sodium bicarbonate, lithium bicarbonate, potassium bicarbonate, lithium carbonate, potassium carbonate, sodium carbonate, beryllium carbonate, magnesium carbonate, calcium carbonate, barium carbonate, and combinations thereof, to maintain the emulsion at a pH of from about 6.5 to about 8, contacting the resin emulsion with at least one surfactant, an optional colorant and an optional wax to form small particles, aggregating the small particles, coalescing the aggregated particles to form toner particles, and recovering the toner particles.

DESCRIPTION OF THE DRAWINGS

Various embodiments of the present disclosure will be described herein below with reference to the figures wherein.

DETAILED DESCRIPTION

Figure 1:
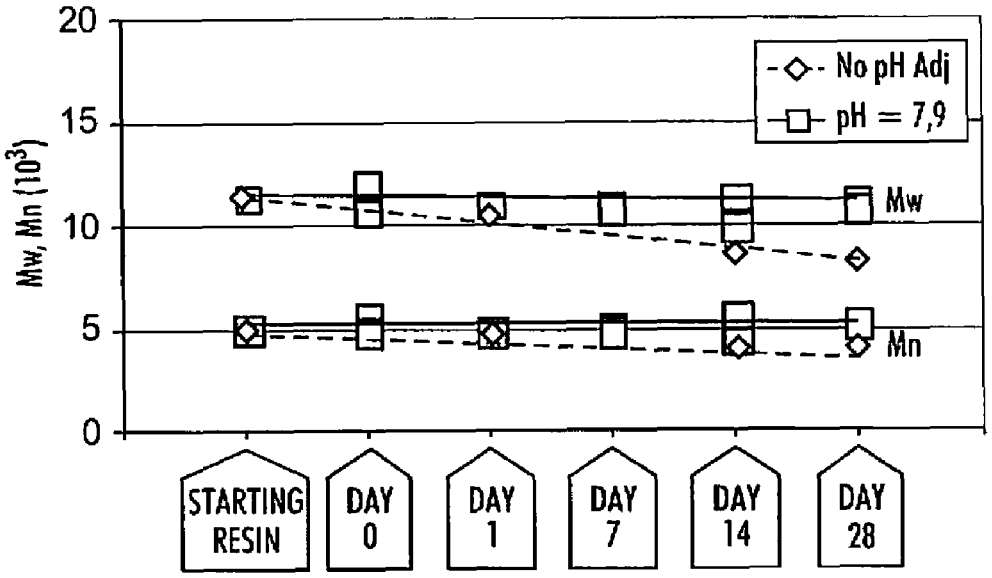
FIG. 1 is a graph comparing Mw and Mn for a resin emulsion treated with a pH adjustment in accordance with the present disclosure compared to the untreated resin emulsion control.

In embodiments of the present disclosure, resin emulsions may be prepared having enhanced stability and shelf life. The resin emulsions with enhanced stability and shelf life may be subjected to a pH adjustment, both during and after the formation of emulsions possessing such resins, in embodiments polyester resins. It has been surprisingly found that without this pH adjustment, the prepared emulsions are not stable, the pH may become more acidic with time (in some cases in only a matter of days), and the resin properties, including Molecular Weight (Mw) and viscosity, may become degraded over time.

In accordance with the present disclosure, a pH adjustment process is provided which stabilizes and extends the life of polyester resin emulsions which, in turn, may be utilized in the formation of toner particles. This pH adjustment process may be utilized with many types of emulsification procedures, including solvent flashing, phase inversion, melt mixing such as extrusion, and/or solventless emulsification, and the like.

The resulting resins may then be recovered from the resin emulsion and utilized to produce toners by processes including chemical processes which involve the aggregation and fusion of a latex resin with a colorant, an optional wax and other optional additives. The toner particles thus produced may form toner sized aggregates. The aggregation may be followed by coalescence or fusion by heating the resulting aggregates to form toner particles.

Resins

Resins treated in accordance with the present disclosure may include any latex resin suitable for use in forming a toner. Such resins, in turn, may be made of any suitable monomer.

Suitable monomers useful in forming the resin include, but are not limited to, acrylonitriles, diols, diacids, diamines, diesters, mixtures thereof, and the like. Any monomer employed may be selected depending upon the particular polymer to be utilized.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin, although the amounts can be outside of these ranges.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent, although the amounts can be outside of these ranges.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), and copoly (ethylene-fumarate)-copoly(ethylene-dodecanoate). The crystalline resin may be present, for example, in an amount of from about 5 to about 50 percent by weight of the toner components, in embodiments from about 10 to about 35 percent by weight of the toner components, although the amounts can be outside of these ranges. The crystalline resin can possess various melting points of, for example, from about 30° C. to about 120° C., in embodiments from about 50° C. to about 90° C., although the melting point can be outside of these ranges. The crystalline resin may have a number average molecular weight (Mn), as measured by gel permeation chromatography (GPC) of, for example, from about 1,000 to about 50,000, in embodiments from about 2,000 to about 25,000 (although the Mn can be outside of these ranges), and a weight average molecular weight (Mw) of, for example, from about 2,000 to about 100,000, in embodiments from about 3,000 to about 80,000 (although the Mw can be outside of these ranges), as determined by Gel Permeation Chromatography using polystyrene standards. The molecular weight distribution (Mw/Mn) of the crystalline resin may be, for example, from about 2 to about 6, in embodiments from about 3 to about 4, although the molecular weight distribution can be outside of these ranges.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin, although the amounts can be outside of these ranges.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin, although the amounts can be outside of these ranges.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin, although the amounts can be outside of these ranges.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-funmarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly( 1,2-propylene itaconate), and combinations thereof.

In embodiments, a suitable amorphous polyester resin may be a poly(propoxylated bisphenol A co-fumarate) resin having the following formula (I):

(I)

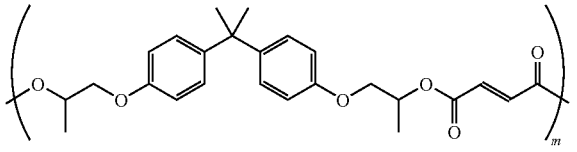

wherein m may be from about 5 to about 1000, although m can be outside of this range. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, North Carolina and the like.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(II)

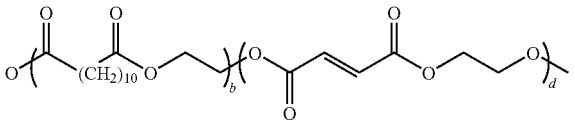

wherein b is from 5 to 2000 and d is from 5 to 2000, although the values of b and/or d can be outside of these ranges.

One, two, or more toner resins may be used. In embodiments where two or more toner resins are used, the toner resins may be in any suitable ratio (e.g., weight ratio) such as for instance about 10% first resin/90% second resin to about 90% first resin/10% second resin, although the ratio can be outside of these ranges. In embodiments, the amorphous resin utilized in the core may be linear.

As noted above, in embodiments, the resin may be formed by polycondensation reaction methods. Utilizing such methods, the resin will be present in a resin emulsion, which may then be stabilized with the pH adjustments of the present disclosure.

pH Adjustment

For polyesters exposed to elevated temperatures in the presence of water, the polyester chains have a tendency to hydrolyze and break up (or depolymerize) due to Le Chatelier's Principle. Such hydrolysis may have several undesirable effects on the resins, including reducing molecular weight (Mw) and/or viscosity of the resins.

In accordance with the present disclosure, problems associated with degradation of the resin over time, including reduction of the Mw of the resin, may be avoided and/or minimized by the addition of a base both during and/or after the formation of the resin emulsion in what may be referred to herein, in embodiments, as a pH adjustment.

Suitable bases which may be added for the pH adjustment include, for example, an alkali metal hydroxide, such as sodium hydroxide (NaOH), ammonium hydroxide, potassium hydroxide, lithium hydroxide, beryllium hydroxide, magnesium hydroxide, calcium hydroxide, or barium hydroxide; ammonium hydroxide; an alkali metal carbonate, such as sodium bicarbonate, lithium bicarbonate($Li_2CO_3$), potassium bicarbonate, lithium carbonate, potassium carbonate, sodium carbonate, beryllium carbonate, magnesium carbonate, calcium carbonate, barium carbonate, combinations thereof, and the like.

For highly sulfonated polyesters wherein emulsification is carried out simply by stirring the resin in water at elevated temperature (less than 90° C.), pH control by the addition of a base during and/or after emulsification may thus improve resin stability with time.

For polyesters with lower levels of sulfonation, other methods of emulsification may be utilized, such as solvent flashing. For example, in embodiments, solvent flashing may be utilized with sulfonated crystalline and amorphous (branched) polyesters by dissolving the resin(s) in acetone at about 50° C., and then metering the resin solution into heated deionized water (DIW) at about 80° C. in order to flash off the acetone solvent using a distillation device, thereby forming the resin emulsion.

For non-sulfonated polyesters, solvent flashing, phase inversion emulsification, melt mixing such as extrusion, and/ or solventless emulsification can be used to prepare an emulsion. In the phase inversion emulsification method, a non-sulfonated polyester resin (crystalline or amorphous) may be dissolved in a suitable solvent, in embodiments a mixture of methyl ethyl ketone (MEK) and isopropyl alcohol (IPA) at a temperature of from about 45° C. to about 80° C., although temperatures outside this range can be used, to form a resin solution. A base solution, in embodiments heated DIW in combination with a base described above, in embodiments ammonium hydroxide, may be formed, with the base solution then added to the resin solution. After combination of the resin and base solution, the solvent may be removed by any method within the purview of those skilled in the art.

As noted above, in embodiments, bases utilized to adjust the pH of a resin emulsion may be in a solution. Suitable solvents for forming such solutions include, but are not limited to, deionized water. In other embodiments, no solvent may be used and the base may be a dry powder.

Regardless of how the resin emulsion may be formed, the resin emulsion may be then cooled to about room temperature, in embodiments from about 20° C. to about 35° C., at or after which time a base may be added. The optimal level of pH during and/or after emulsification may depend, in part, on the structure of the resins. In embodiments, it may be desirable to adjust the pH of the resin emulsion to a level of from about 6.5 to about 8, in embodiments about 7, which has desirable effects on the stability and shelf life of the emulsion, including reducing the drop in molecular weight of the resin which would otherwise occur with the passage of time.

As noted above, the pH adjustment may occur both at the time of forming the resin emulsion, and/or subsequent thereto. The pH of the resin emulsion may be monitored at any desirable interval, including hourly, daily, weekly, monthly, combinations thereof, and the like, with a base added thereto, where necessary, to maintain the pH of the resin emulsion at from about 6.5 to 8, although a pH outside this range can be used. In embodiments, the pH of the resin emulsion may be monitored daily. Monitoring the pH may occur utilizing any pH indicator within the purview of those skilled in the art.

The amount of base added to adjust the pH of the resin emulsion will vary depending upon the resin components, the base utilized, its concentration, the degree or amount of pH adjustment required (i.e., the amount will vary depending upon how acidic the resin emulsion is upon testing), etc.

The amount of base used may be from about 0.001% to about 10% of a 1 molar solution based on the amount of resin emulsion used, in embodiments from about 0.0015% to about 1% of a 1 molar solution based on the amount of resin emulsion used.

As noted above, the pH adjustment of the present disclosure may be useful in preventing a loss in Mw of resins contained in the resin emulsion. For example, for resins not subjected to pH adjustment in accordance with the present disclosure, the resins in the resin emulsion at the time of formation may have a Mw of from about 2,000 to about 100,000, in embodiments from about 30,000 to about 80,000, but may experience a decrease in Mw of from about 8% to about 50%, in embodiments from about 10% to about 25%, after a period of time of from about 3 days to about 30 days, in embodiments from about 5 days to about 20 days. To the contrary, resins in a resin emulsion treated in accordance with the present disclosure so that the resin emulsion maintains a pH of from about 6.5 to about 8, in embodiments about 7, may either exhibit no decrease in Mw over time, or only exhibit a decrease in Mw of from about 0.05% to about 10%, in embodiments from about 0.1% to about 5%, after a period of time of from about 3 days to about 30 days, in embodiments from about 5 days to about 20 days.

Toner

The resin of the resin emulsions described above, in embodiments a polyester resin, may be utilized to form toner compositions. Such toner compositions may include optional colorants, waxes, and other additives. Toners may be formed utilizing any method within the purview of those skilled in the art.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition, although the amounts can be outside of these ranges.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the optional colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner, although the amounts can be outside of these ranges.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FOL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and an optional colorant in forming toner particles. When included, the wax may be present in an amount of, for example, from about 1 weight percent to about 25 weight percent of the toner particles, in embodiments from about 5 weight percent to about 20 weight percent of the toner particles, although the amounts can be outside of these ranges.

Waxes that may be selected include waxes having, for example, a weight average molecular weight of from about 500 to about 20,000, in embodiments from about 1,000 to about 10,000, although the weights can be outside of these ranges. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 4.5, although the pH can be outside of this range. Additionally, in embodiments, the mixture may be homogenized. If the mixture is homogenized, homogenization may be accomplished by mixing at about 600 to about 4,000 revolutions per minute, although the speed of mixing can be outside of this range. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture, although the amounts can be outside of these ranges. This provides a sufficient amount of agent for aggregation.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may also be done while the mixture is maintained under stirred conditions, in embodiments from about 50 rpm to about 1,000 rpm, in other embodiments from about 100 rpm to about 500 rpm (although the mixing speed can be outside of these ranges), and at a temperature that is below the glass transition temperature of the resin as discussed above, in embodiments from about 30° C. to about 90° C., in embodiments from about 35° C. to about 70° C. (although the temperature can be outside of these ranges).

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C. (although the temperature can be outside of this range), and holding the mixture at this temperature for a time from about 0.5 hours to about 6 hours, in embodiments from about hour 1 to about 5 hours (although time periods outside of these ranges can be used), while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Shell Resin

In embodiments, an optional shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration.

Once the desired final size of the toner particles is achieved, the pH of the mixture may be adjusted with a base to a value of from about 6 to about 10, and in embodiments from about 6.2 to about 7, although a pH outside of these ranges can be used. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture, although amounts outside of these ranges can be used.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C. (although temperatures outside of these ranges can be used), which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours, although periods of time outside of these ranges can be used.

After coalescence, the mixture may be cooled to room temperature, such as from about 20° C. to about 25° C. (although temperatures outside of this range can be used). The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner, although amounts outside of these ranges can be used. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner, although amounts outside these ranges can be used. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with a shell resin described above or after application of the shell resin.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 3 to about 20 μm, in embodiments from about 4 to about 15 μm, in other embodiments from about 5 to about 9 μm, although a volume average diameter outside these ranges can be obtained.

(2) Number Average Geometric Standard Deviation (GSDn) and/or Volume Average Geometric Standard Deviation (GSDv) of from about 1.05 to about 1.55, in embodiments from about 1.1 to about 1.4, although a GSDv outside these ranges can be obtained.

(3) Circularity of from about 0.9 to about 1 (measured with, for example, a Sysmex FPIA 2100 analyzer), in embodiments form about 0.95 to about 0.985, in other embodiments from about 0.96 to about 0.98, although a circularity outside these ranges can be obtained.

(4) Glass transition temperature of from about 40° C. to about 65° C., in embodiments from about 55° C. to about 62° C., although a glass transition temperature outside these ranges can be obtained.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −35 μC/g, and a final toner charging after surface additive blending of from −10 μC/g to about −45 μC/g, although values outside these ranges can be obtained.

In accordance with the present disclosure, the charging of the toner particles may be enhanced, so less surface additives may be required, and the final toner charging may thus be higher to meet machine charging requirements.

Developers

The toner particles may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer, although amounts outside these ranges can be used.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %, although amounts outside these ranges can be used. The coating may have a coating weight of, for example, from about 0.1 to about 5% by weight of the carrier, in embodiments from about 0.5 to about 2% by weight of the carrier, although amounts outside these ranges can be used.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles (although amounts outside these ranges can be used), until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size (although sizes outside these ranges can be used), coated with about 0.5% to about 10% by weight, in embodiments from about 0.7% to about 5% by weight (although amounts outside these ranges can be used) of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition (although amounts outside these ranges can be used). However, different toner and carrier percentages may be used to achieve a developer composition with desired characteristics.

Imaging

The toners can be utilized for electrostatographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C. (although temperatures outside these ranges can be used), after or during melting onto the image receiving substrate.

In embodiments where the toner resin is crosslinkable, such crosslinking may be accomplished in any suitable manner. For example, the toner resin may be crosslinked during fusing of the toner to the substrate where the toner resin is crosslinkable at the fusing temperature. Crosslinking also may be effected by heating the fused image to a temperature at which the toner resin will be crosslinked, for example in a post-fusing operation. In embodiments, crosslinking may be effected at temperatures of from about 160° C. or less, in embodiments from about 70° C. to about 160° C., in other embodiments from about 80° C. to about 140° C., although temperatures outside these ranges can be used.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 35° C.

EXAMPLES

Comparative Example 1

Preparation of sulfonated crystalline polyester emulsion with no pH adjustment. About 125 grams of a linear crystalline polyester resin derived from dodecanedioic acid, sebacic acid and 5-lithium sulfoisophthalic acid as disclosed in U.S. Pat. No. 7,425,398, the disclosure of which is incorporated by reference in its entirety, was measured into a 2 liter glass beaker containing about 1,000 grams of acetone. The mixture was stirred at about 250 revolutions per minute and heated to about 50° C. to substantially dissolve the resin in the acetone. About 1,000 grams of deionized water was measured into a 2 liter glass beaker and heated to about 80° C. The heated water was then poured into a heated 4 liter Pyrex glass flask reactor connected to a distillation device and stirred at about 400 revolutions per minute. The resin solution was then metered into the heated water at about 6 grams per minute while the resin/acetone/water mixture was maintained at about 80° C. to distill off the acetone from the mixture. At the completion of metering of the resin solution, the mixture was stirred for about an additional 90 minutes, followed by cooling at about 2° C. per minute until reaching room temperature and screening through a 20 micron sieve. The resulting resin emulsion included about 13.5 percent by weight resin in water as measured gravimetrically, had a pH of about 5.1, and had a volume average diameter of about 50.6 nanometers as measured with a HONEYWELL MICROTRAC® UPA150 particle size analyzer.

Example 1

Preparation of sulfonated crystalline polyester emulsion with a pH adjustment to about 7. About 125 grams of the linear crystalline polyester resin described in Comparative Example 1 above was measured into a 2 liter glass beaker containing about 1,000 grams of acetone. The mixture was stirred at about 250 revolutions per minute and heated to about 50° C. to substantially dissolve the resin in the acetone. About 1,000 grams of deionized water was measured into a 2 liter glass beaker, heated to about 80° C. and adjusted to a pH of about 7 with the addition of about 1 molar $Li_2CO_3$. The heated water was then poured into a heated 4 liter Pyrex glass flask reactor connected to a distillation device and stirred at about 400 revolutions per minute. The resin solution was then metered into the heated water at about 6 grams per minute while the resin/acetone/water mixture was maintained at about 80° C. to distill off the acetone from the mixture. At intervals of about 60 minutes, the pH of the mixture raised to about 7 with additional 1 molar $Li_2CO_3$. At the completion of metering of the resin solution, the mixture was stirred for about an additional 90 minutes followed by cooling at about 2° C. per minute to room temperature, screening through a 20 micron sieve and a final pH increase to about 7 with the addition of more 1 molar $Li_2CO_3$. The resulting resin emulsion included about 13.1 percent by weight resin in water, and had a volume average diameter of about 47 nanometers.

Example 2

Preparation of sulfonated crystalline polyester emulsion with a pH adjustment to about 9. A second resin emulsion was prepared using the procedure of Example 1 above, with the exception that the pH adjustment during and at the end of solvent flashing was carried out to about 9. The resulting resin emulsion included about 13.3 percent by weight resin in water as measured gravimetrically, and had a volume average diameter of about 27 nanometers.

Example 3

Stability Study. Resin emulsions of Comparative Example 1 and Examples 1 and 2 above were stored in sealed containers at about room temperature and were marked with the date of preparation. To characterize the stability of each emulsion, the pH and volume-average diameter were measured at the following times: day 0, day 1, day 7, day 14 and day 28. Similarly, at these times, about 30 grams of each emulsion was removed from the containers, air dried in an aluminum dish at about room temperature for about 24 hours and then dried in a vacuum oven at about 40° C. for about an additional 48 hours.

The samples were subsequently characterized as follows: melt viscosity was measured with a Paar-Physica Rheolab MC1 viscometer (Anton Paar USA), number-average and volume-average molecular weight was measured by GPC, and peak melting temperature was measured by DSC. The results are shown in FIGS. 1 to 3.

Figure 2:
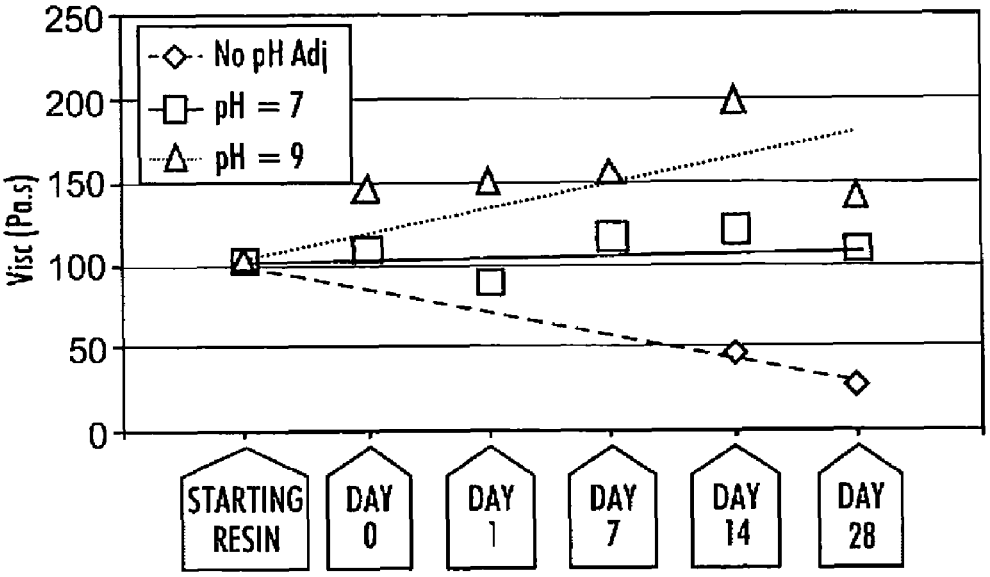
FIG. 2 is a graph comparing viscosity for resin emulsions treated with a pH adjustment in accordance with the present disclosure compared to the untreated resin emulsion control.
Figure 3:
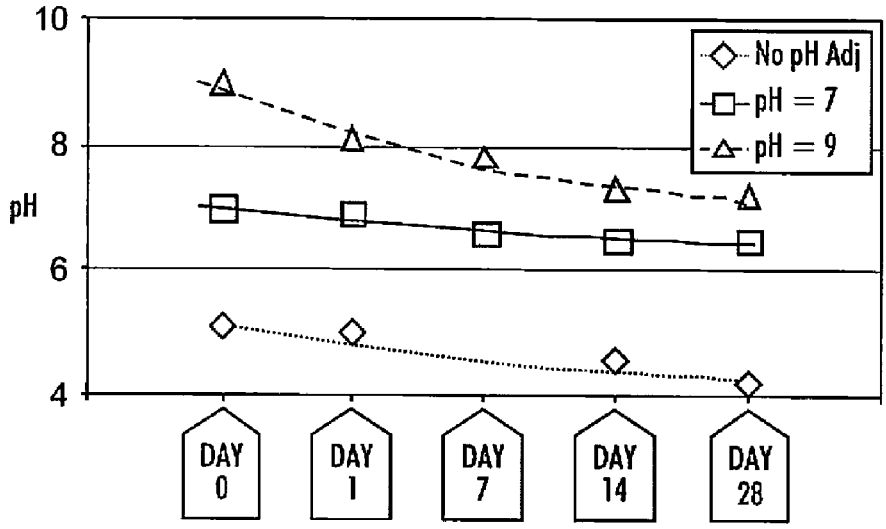
FIG. 3 is a graph showing change in pH for resin emulsions treated with a pH adjustment in accordance with the present disclosure compared to the untreated resin emulsion control.

As can be seen from FIGS. 1-3, while emulsions without pH adjustment showed significant decrease in Mw after 14 days, emulsions adjusted to pH 7 showed substantially no change in Mw after 28 days, and there was no apparent additional benefit of adjustment to a higher pH. No significant changes in emulsion particle size were detected at any of the levels of pH adjustment.

Example 4

Preparation of non-sulfonated linear amorphous emulsion. About 54 kilograms of a linear amorphous propoxylated bisphenol A fumarate polyester resin was measured into a 150 gallon reactor containing about 16.2 kilograms of methyl ethyl ketone, about 0.324 kilograms of isopropyl alcohol and about 2.087 kilograms of 10% by weight ammonium hydroxide. The linear amorphous resin was of the following formula:

(I)

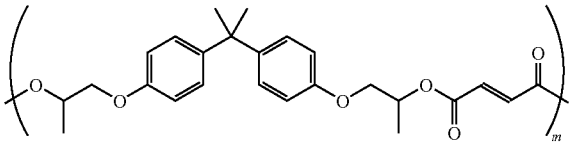

wherein m was from about 5 to about 1000 and was produced following the procedures described in U.S. Pat. No. 6,063,827, the disclosure of which is hereby incorporated by reference in its entirety. The mixture was stirred at a rate of from about 50 to about 65 revolutions per minute and heated to about 45° C. to substantially dissolve the resin in the solvents. A total of about 162 kilograms of deionized water was metered into the resin solution at a rate of about 1.2 kilograms per minute over about 90 minutes and the remaining deionized water was added in at a rate of about 1.8 kilograms per minute over about 30 minutes. At the completion of metering of the resin solution, the reactor was cooled to about 40° C. and a vacuum was used to remove the solvents followed by cooling at about 2° C. per minute to about room temperature, screening through a 20 micron sieve and a final pH increase to about 7 by the addition of about 1 M NaOH. The resulting resin emulsion included about 24 percent by weight resin in water, and had a volume average diameter of about 195 nanometers.

Figure 4:
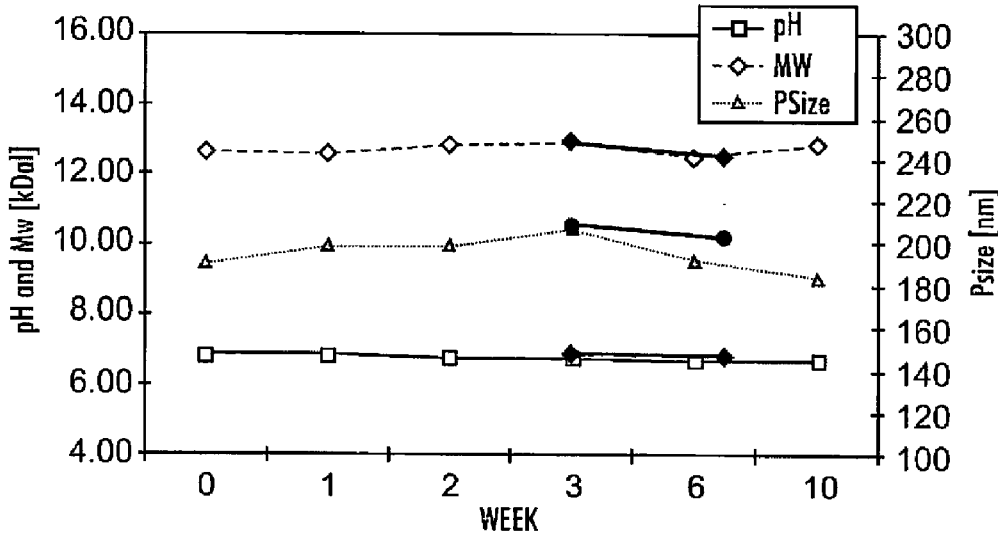
FIG. 4 is a graph of data for an amorphous polyester resin emulsion where the light lines are not treated with a pH adjustment in accordance with the present disclosure and the dark lines are treated, showing pH, Mw, and particle size (Psize)

The stability of this emulsion was monitored as described above in Example 3. At a pH of about 7, the amorphous resin emulsion thus produced demonstrated good stability over a period of at least about 10 weeks, as shown in FIG. 4. As can be seen in FIG. 4, whether the pH was maintained at about 7 or not (lighter colors) the Mw, pH and particle size (Psize) did not significantly change.

In addition to the added stability observed with the higher pH, a more basic pH range may also be beneficial in reducing unwanted bacterial and/or mold growth.

Example 5

Preparation of non-sulfonated unsaturated crystalline emulsion. An emulsion including an unsaturated crystalline polyester ("UCPE") resin was prepared using the procedure of Example 4, with the exception that both the solvent/resin mixture and deionized water was heated and maintained at about 65° C. The UCPE resin was composed of ethylene glycol and a mixture of dodecanedioic acid and fumaric acid co-monomers with the following formula:

(II)

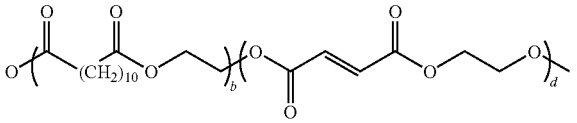

wherein b is from 5 to 2000 and d is from 5 to 2000 in an emulsion (about 19.98 weight % resin), synthesized following the procedures described in U.S. Patent Application Publication No. 2006/0222991, the disclosure of which is hereby incorporated by reference in its entirety.

A portion of the resin was subjected to pH adjustments as described herein for a resin/process of the present disclosure; a portion of the resin was not subjected to pH adjustment and thus served as a control. Tables 1 and 2 below summarize the emulsions and their properties: Table 1 includes the data for the UCPE emulsion with no pH adjustments that served as a control; Table 2 includes the data for the UCPE emulsion with pH adjustments in accordance with the present disclosure. Particle size, Mw, Mn, melting temperature (Tm) and viscosity were all obtained as described above in Example 3.

TABLE 1

UCPE Emulsion without pH adjustments

| Day | pH | g NaOH add | P Size (nm) | Mw | Mn | Tm (° C.) | μ (Pa · s) @ 85 |
|---|---|---|---|---|---|---|---|
| 0 | — | — | — | 53,300 | 10,400 | 81.2 | 30.00 |
| About 11 months later | — | — | — | 37,300 | 8,000 | NA | 15.50 |
| 0 | 7.18 | — | 245.00 | NA | — | NA | NA |
| 28 | 6.53 | — | 244.8 | 29,336 | 8,400 | 79.01 | 14.70 |
| 35 | 6.07 | — | 252.7 | 28,915 | 8,326 | 78.26 | 11.95 |
| 41 | 5.97 | — | 248.6 | 30,101 | 6,539 | 78.92 | 12.60 |
| 45 | 5.92 | — | 272.8 | 27,481 | 6,184 | 79.75 | 13.50 |
| 52 | 5.87 | — | 238 | 27,571 | 6,380 | 78.17 | 11.60 |
| 59 | 5.80 | — | 232.7 | 25,821 | 5,866 | 80.31 | 13.20 |

TABLE 2

UCPE Emulsion with pH adjustments

| Day | pH | g NaOH add | P Size (nm) | Mw | Mn | Tm (° C.) | μ (Pa · s) @ 85 |
|---|---|---|---|---|---|---|---|
| 24 | 6.93→7.00 | 0.28 | 246.3 | 29,817 | 7,900 | 80.6 | 17.10 |
| 30 | 6.53→7.00 | 1.98 | — | — | — | — | — |
| 31 | 6.90→7.00 | 0.43 | — | — | — | — | — |
| 35 | 6.71→7.00 | 1.19 | 238.9 | 29,050 | 8,453 | 80.81 | 16.95 |
| 36 | 6.84 | — | — | — | — | — | — |
| 37 | 6.80 | — | — | — | — | — | — |
| 38 | 6.74→7.00 | 0.89 | — | — | — | — | — |
| 41 | 6.72 | — | 233.4 | 29,308 | 6,473 | 80.63 | 17.25 |
| 42 | 6.67 | — | — | — | — | — | — |
| 43 | 6.64 | — | — | — | — | — | — |
| 44 | 6.57 | — | — | — | — | — | — |
| 45 | 6.53→7.00 | 1.93 | 253.7 | — | — | — | — |
| 49 | 6.86 | — | — | 28,289 | 6,773 | 80.27 | 18.40 |
| 50 | 6.79 | — | — | — | — | — | — |
| 51 | 6.74 | — | — | — | — | — | — |
| 52 | 6.73→7.00 | 0.89 | 230.2 | — | — | — | — |
| 55 | 6.86 | — | — | 28,639 | 7,191 | 79.21 | 17.05 |
| 56 | 6.85 | — | — | — | — | — | — |
| 57 | 6.84 | — | — | — | — | — | — |
| 58 | 6.80 | — | — | — | — | — | — |
| 59 | 6.77→7.00 | 0.63 | 224.7 | — | — | — | — |
| 63 | 6.87 | — | — | 26,452 | 5,895 | 78.17 | 15.45 |

Figure 5:
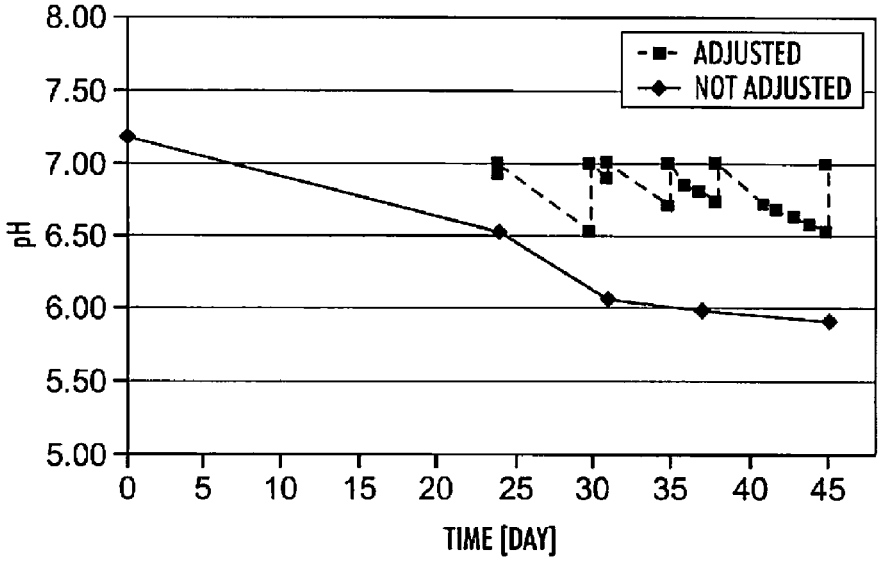
FIG. 5 is a graph of pH measurements of an unsaturated crystalline polyester (UCPE) resin emulsion treated with a pH adjustment in accordance with the present disclosure compared with the untreated resin emulsion control.
Figure 6:
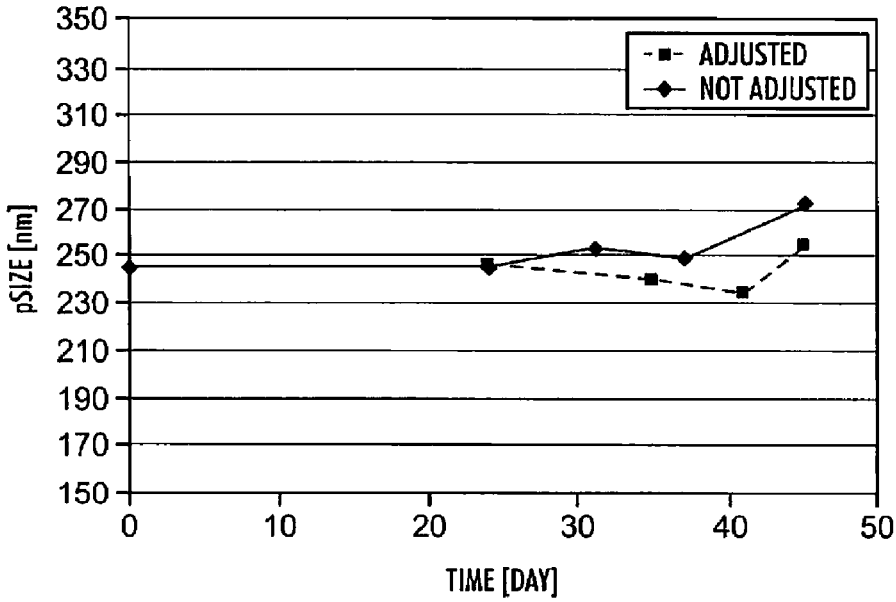
FIG. 6 is a graph of the particle size measurements of the unsaturated crystalline polyester (UCPE) resin emulsion treated with a pH adjustment in accordance with the present disclosure compared with the untreated resin emulsion control.
Figure 7:
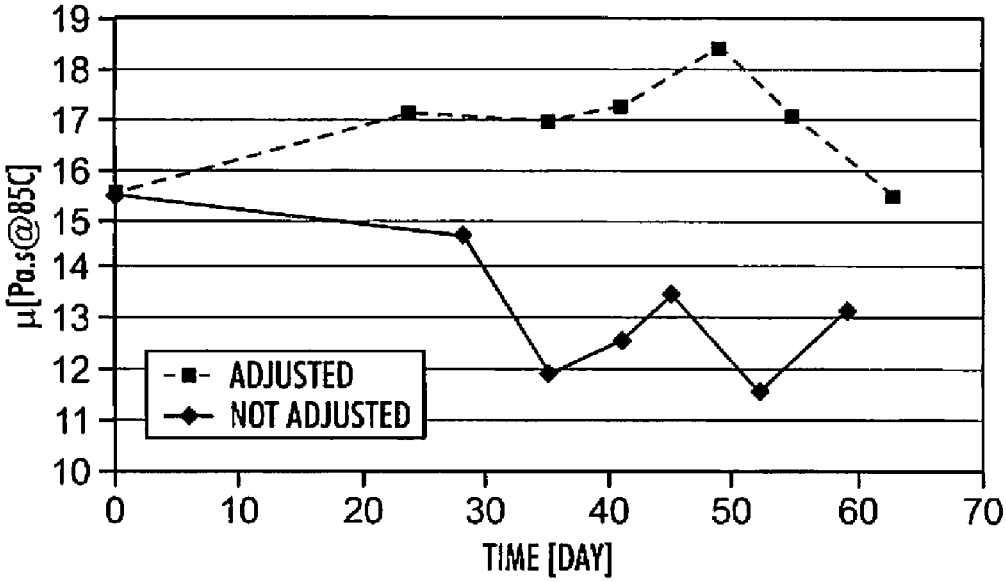
FIG. 7 is a graph of the viscosity measurements of the unsaturated crystalline polyester resin (UCPE) emulsion treated with a pH adjustment in accordance with the present disclosure compared with the untreated resin emulsion control.

To briefly summarize, FIG. 5 shows the pH measurements of the unsaturated crystalline polyester (UCPE) emulsion; FIG. 6 shows the particle size measurements of the unsaturated crystalline polyester (UCPE) emulsion; FIG. 7 shows the viscosity measurements of the unsaturated crystalline polyester (UCPE) emulsion.

While samples were not taken during weeks 1-3, it can be seen that the degradation of the UCPE resin continued over the next 4 weeks without pH adjustment. Although the GPC data (Mw, Mn) in this example did not show a large variation from "without pH adjustment" to that "with pH adjustment", it is more likely due to the sensitivity of the measurement system; in looking at viscosity, a more sensitive measurement system for crystalline resins, the data confirmed a definite degradation. For example, the Figures show viscosity was maintained in the "pH adjustment" emulsion until week 7, as compared to the "without pH adjustment" emulsion.

In looking at the particle size tracking, the data shows that the emulsion without pH adjustment maintained a higher particles size over all as compared with the emulsion that had been pH adjusted. Also, the emulsion without pH adjustment thickened.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

forming a polyester resin emulsion;

monitoring the pH of the emulsion; and adding a base to the emulsion to maintain the emulsion at a pH of about 8, wherein a resin in the resin emulsion exhibits a decrease in molecular weight of from about 0.1% to about 5% after a period of time of from about 3 days to about 30 days.

2. A process according to claim 1, wherein the polyester resin comprises at least one amorphous resin selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

3. A process according to claim 1, wherein the polyester resin comprises a poly(propoxylated bisphenol A co-fumarate) resin of the formula:

(I)

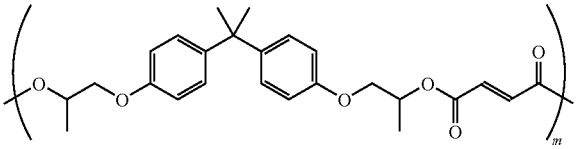

wherein m may be from about 5 to about 1000.

4. A process according to claim 1, wherein the polyester resin comprises a crystalline resin selected from the group consisting of poly(ethylene-adipate), poly(propylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof.

5. A process according to claim 1, wherein the base is selected from the group consisting of sodium hydroxide, ammonium hydroxide, potassium hydroxide, lithium hydroxide, beryllium hydroxide, magnesium hydroxide, calcium hydroxide, barium hydroxide, ammonium hydroxide, sodium bicarbonate, lithium bicarbonate, potassium bicarbonate, lithium carbonate, potassium carbonate, sodium carbonate, beryllium carbonate, magnesium carbonate, calcium carbonate, barium carbonate, and combinations thereof.

6. A process according to claim 1, wherein the polyester emulsion is formed by a process selected from the group consisting of solvent flashing, phase inversion emulsification, solventless emulsification, melt mixing, extrusion, and combinations thereof.

7. A process according to claim 1, further comprising cooling the resin emulsion to a temperature of from about 20° C. to about 35° C. prior to monitoring the pH of the emulsion.

8. A process according to claim 1, wherein monitoring the pH of the emulsion occurs with a frequency selected from the group consisting of hourly, daily, weekly, monthly, and combinations thereof.

9. A process according to claim 1, wherein monitoring the pH of the emulsion utilizes a pH indicator.

10. A process according to claim 1, further comprising contacting the resin emulsion with at least one surfactant, an optional colorant and an optional wax to form small particles;

aggregating the small particles;

coalescing the aggregated particles to form toner particles; and recovering the toner particles.

11. A process according to claim 10, wherein the optional colorant comprises dyes, pigments, combinations of dyes, combinations of pigments, and combinations of dyes and pigments, in an amount of from about 0.1 to about 35 percent by weight of the toner, and the optional wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, cholesteryl stearate, and combinations thereof, present in an amount from about 1 weight percent to about 25 weight percent of the toner.

12. A process comprising:

forming a polyester resin emulsion;

monitoring the pH of the emulsion; and adding to the emulsion a base selected from the group consisting of sodium hydroxide, ammonium hydroxide, potassium hydroxide, lithium hydroxide, beryllium hydroxide, magnesium hydroxide, calcium hydroxide, barium hydroxide, ammonium hydroxide, sodium bicarbonate, lithium bicarbonate, potassium bicarbonate, lithium carbonate, potassium carbonate, sodium carbonate, beryllium carbonate, magnesium carbonate, calcium carbonate, barium carbonate, and combinations thereof, to maintain the emulsion at a pH of about 8, wherein adding the base to the emulsion prevents a decrease in the molecular weight of the resin in the emulsion.

13. A process according to claim 12, wherein the polyester resin comprises at least one amorphous resin selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

14. A process according to claim 12, wherein the polyester resin comprises a crystalline resin selected from the group consisting of poly(ethylene adipate), polypropylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), polypropylene-sebacate), poly(butylene-sebacate), poly(pentylene-sebacate), poly(hexylene-sebacate), poly(octylene-sebacate), alkali copoly(5-sulfoisophthaloyl)- copoly(ethylene-adipate), poly (decylene-sebacate), poly(decylene-decanoate), poly-(ethylene-decanoate), poly-(ethylene-dodecanoate), poly (nonylene-sebacate), poly (nonylene-decanoate), copoly (ethylene-fumarate)-copoly(ethylene-sebacate), copoly (ethylene-fumarate)-copoly(ethylene-decanoate), copoly (ethylene-fumarate)-copoly(ethylene-dodecanoate), and combinations thereof.

15. A process according to claim 12, wherein the base is in a dry powder form or in a solution comprising deionized water.

16. A process according to claim 12, wherein the polyester emulsion is formed by a process selected from the group consisting of solvent flashing, phase inversion emulsification, solventless emulsification, melt mixing, extrusion, and combinations thereof.

17. A process according to claim 12, further comprising cooling the resin emulsion to a temperature of from about 20° C. to about 35° C. prior to monitoring the pH of the emulsion.

18. A process according to claim 12, wherein monitoring the pH of the emulsion occurs with a frequency selected from the group consisting of hourly, daily, weekly, monthly, and combinations thereof.

19. A process comprising:

forming a polyester resin emulsion;

monitoring the pH of the emulsion;

adding to the emulsion a base selected from the group consisting of sodium hydroxide, ammonium hydroxide, potassium hydroxide, lithium hydroxide, beryllium hydroxide, magnesium hydroxide, calcium hydroxide, barium hydroxide, ammonium hydroxide, sodium bicarbonate, lithium bicarbonate, potassium bicarbonate, lithium carbonate, potassium carbonate, sodium carbonate, beryllium carbonate, magnesium carbonate, calcium carbonate, barium carbonate, and combinations thereof, to maintain the emulsion at a pH of about 8;

contacting the resin emulsion with at least one surfactant, an optional colorant and an optional wax to form small particles;

aggregating the small particles;

coalescing the aggregated particles to form toner particles; and recovering the toner particles, wherein a resin in the resin emulsion exhibits a decrease in molecular weight of from about 0.1% to about 5% after a period of time of from about 3 days to about 30 days.

20. A process according to claim 19, wherein the optional colorant comprises dyes, pigments, combinations of dyes, combinations of pigments, and combinations of dyes and pigments, in an amount of from about 0.1 to about 35 percent by weight of the toner, and the optional wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, cholesteryl stearate, and combinations thereof, present in an amount from about 1 weight percent to about 25 weight percent of the toner.

* * * * *